US005469951A

United States Patent [19]

Takemoto et al.

[11] Patent Number: 5,469,951

[45] Date of Patent: Nov. 28, 1995

[54] COIN COUNTER FOR SLOT MACHINES AND A GAME PARLOR HAVING THE COIN COUNTER THEREIN

[75] Inventors: Takatoshi Takemoto; Kazunari Kawashima, both of Tokyo, Japan

[73] Assignee: Kabushiki Kaisha Ace Denken, Japan

[21] Appl. No.: 219,372

[22] Filed: Mar. 29, 1994

[51] Int. Cl.[6] ..... G07F 7/04; G07F 17/34

[52] U.S. Cl. ..... 194/206; 232/15; 453/32

[58] Field of Search ..... 194/206, 207, 194/217, 350; 186/37, 27, 28; 453/16, 17, 32, 3, 5, 13; 232/15, 16

[56] References Cited

U.S. PATENT DOCUMENTS

| | | | |
|---|---|---|---|
| 3,147,839 | 9/1964 | White | 453/7 X |
| 4,249,552 | 2/1981 | Margolin et al. | 194/207 |
| 4,342,384 | 8/1982 | Fukase et al. | 453/56 X |
| 5,113,990 | 5/1992 | Gabrius et al. | 194/206 |

FOREIGN PATENT DOCUMENTS

| | | |
|---|---|---|
| 62-20228 | 4/1981 | Japan . |
| 62-24110 | 5/1987 | Japan . |

*Primary Examiner*—F. J. Bartuska

*Attorney, Agent, or Firm*—Andrus, Sceales, Starke & Sawall

[57] ABSTRACT

In a coin counter, a coin insert slot 1 where the coins used for the slot machines are inserted, a coin counting unit 3 for counting the number of coins inserted from the coin insert slot 1, a coin tank for storing the coins counted by the coin counting unit 3 and a printing unit 6 for printing out the count result by the coin counting unit 3 on a receipt are provided in a main body thereof. Under the main body, wheels or casters 5 are provided so as to move the main body easily.

14 Claims, 7 Drawing Sheets

COIN COUNTER FOR SLOT MACHINES AND A GAME PARLOR HAVING THE COIN COUNTER THEREIN

BACKGROUND OF THE INVENTION

This invention relates to a coin counter for slot machines, which is provided in a game parlor where a plurality of or, in many cases, a large number of slot machines are provided. The term "coin" used here means game media including a game coin, a game medal, or money coin.

Heretofore, in a game parlor having slot machine islands in which a large number of slot machines are provided, coin counters, for counting the coins obtained by players, and their accessories are fixedly provided at corners of the parlor or parts of the slot machine islands.

It is, however, inconvenient for the players that the coin counter is far from where they are, and that they have to wait in a line for a long time when a lot of players want to count at the same time.

SUMMARY OF THE INVENTION

The present invention is contrived so as to solve the problem as stated above and the object of the present invention is to provide a coin counter for slot machines which is easily used by players and a game parlor having the same.

A coin counter for slot machines for accomplishing the above-described object has a main body having a coin slot where coins used for slot machines are inserted, a coin counting means for counting the number of coins inserted from the coin slot, a coin tank for storing counted coins by the coin counting means, and a count result outputting means for outputting the result of the count by the coin counting means; and wheels provided under the main body so as to move said main body easily.

The coin counter for slot machines may have a bank note slot where bank notes are inserted, a bank note counter for counting the amount of bank notes inserted through the bank note slot, a bank note storing unit for storing bank notes, a coin dispenser for dispensing coins in the amount corresponding to the count result produced by the bank note counter from said coin tank, and a bank note dispensing means for dispensing bank notes, of an amount corresponding to the number of the coins counted by said coin counting means, from the bank note storing unit.

The coin counter for slot machines preferably has a full-up detecting means for detecting whether said coin tank is filled up with said coins or not, and a full-up alarm outputting means for outputting an alarm indicating that the full-up detecting means detects that the coin tank is full.

Rails may be provided on the floor of the game parlor, and said coin counter for slot machines may have an engaging unit which engages with the rails so as to move the counter along said rails.

A large number of slot machines provided in the game parlor may have a calling button and a transmitting means for transmitting the identity number of the slot machine whose calling button is operated, by radio, and the coin counter for slot machines may have a drive means for driving said wheels, a receiving means for receiving said identity number transmitted from said transmitting means and a drive control means for controlling said drive means so as to move close to the slot machine corresponding to the identity number received by the receiving means.

Since the coin counter for slot machines of the present invention has wheels, the coin counter can be moved freely. As a result, when an employee carries the coin counter to a player who wants to count his coins for adjustment, the player can have the coins counted for adjustment where he is. Also, in the situation where a lot of players are in the game parlor, the coin counters can be moved away so as to maintain a good playing environment.

In the case of a coin counter having a drive means for driving wheels, the coin counter moves automatically towards a player in response to his pressing a calling button, the workload of the game parlor employees can be reduced.

DESCRIPTION OF PREFERRED EMBODIMENT

The first embodiment of the present invention will be described according to FIG. 1 thru FIG. 3.

Figure 1:
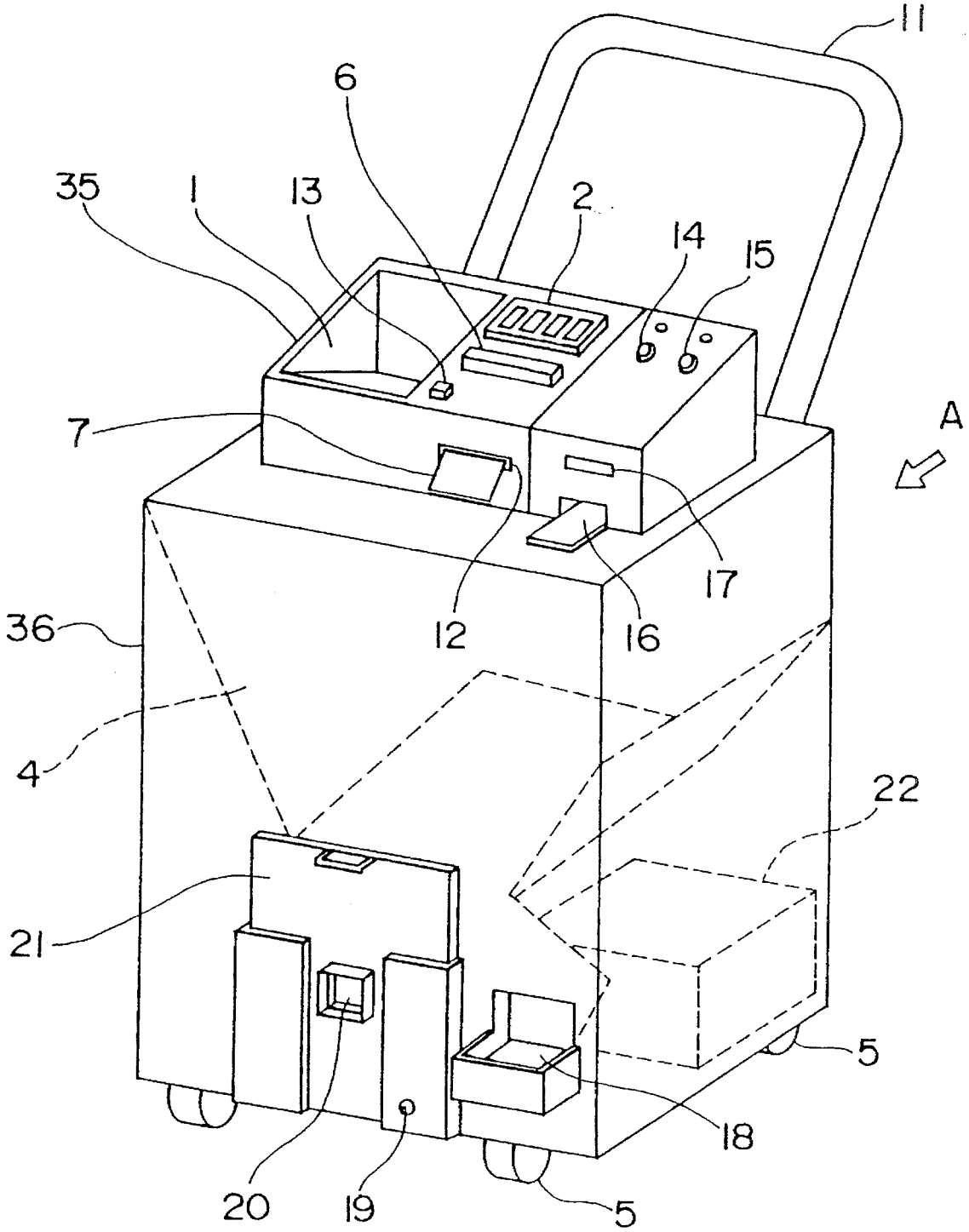
FIG. 1 is a perspective view showing the coin counter for slot machines of the first embodiment of the present invention.
Figure 2:
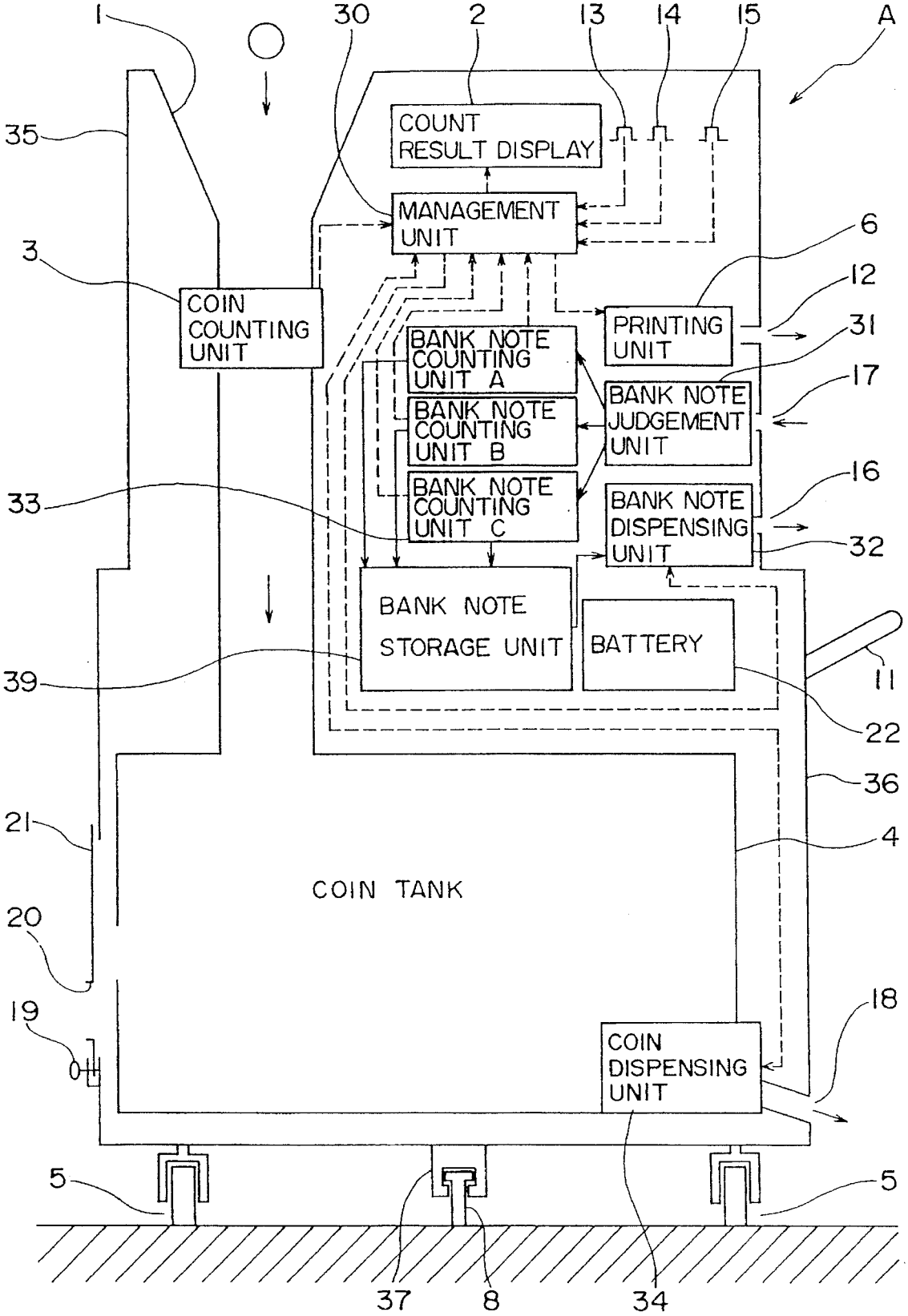
FIG. 2 is an explanatory view showing the inside structure of the coin counter for the slot machines of the first embodiment of the present invention.

A coin counter of the present embodiment, as shown in FIGS. 1 and 2, has a coin slot 1, a coin counting unit 3 for counting the number of coins inserted from the coin slot 1 and a coin tank 4 for storing the coins counted by the coin counting unit 3. The coin counter also has a coin management housing 35 including various machinery and electrical/electronic devices for managing the inserted coins and a coin storage housing 36 including the coin tank 4.

Besides the above-mentioned coin tank 4, a bank note storing unit 39 for sorting and storing bank notes according to their face values, a coin dispensing unit 34 for dispensing coins from the coin tank 4 and a battery 22 for operating each piece of machinery and devices provided in the coin management housing 35 are provided in the coin storage housing 36. A coin dispensing slot 18 for dispensing coins from the coin dispensing unit 34 is formed on the coin storage housing 36. Furthermore, the coin storage housing 36 has an exit board 21 which is slidably, in a vertical direction to the housing 36, provided on the front of the housing. Four wheels or casters 5 are provided under the housing 36, and a bar 11 is provided on the back of the housing 36. A coin discharging slot 20 is formed on the exit board 21. This slidable exit board 21 can be locked by a lock mechanism 19 provided in the housing 36, and as a result, no coins can be taken out from the coin discharging slot 21.

Besides the above-mentioned coin slot 1, a receipt discharging slot 12 for discharging a receipt 7 on which the number of coins is printed, a bank note insert slot 17 and a bank note dispensing slot 16 are formed on the coin management housing 35. The coin management housing 35 further has, in addition to the above-mentioned coin counting unit 3, a count result display unit 2 for displaying the number of the coins counted by the coin counting unit 3, a printing unit 6 for printing the number of coins counted by the coin counting unit 3 on the receipt 7, a bank note judgement unit 31 for judging the bank notes inserted through the bank note insert slot 17 according to their face values, a bank note counting unit 33 for counting the number of bank notes of each value judged by the bank note judgement unit 31 and for conveying the bank notes of every value to a bank note storage unit 39, and a bank note dispensing unit 32 for taking the bank notes out of the bank note storage unit 39 and for conveying them to the bank note dispensing slot 16 and a management unit 30 which is connected to each unit by signal lines so as to manage each unit and which consists of microcomputers. On the front of the coin management housing 35, a print button 13, a bank note dispensing button 14 and a coin dispensing button 15 are provided. These buttons 13, 14 and 15 are so connected to the management unit 30 through signal lines that the signals from these buttons can be sent to the management unit 30.

Figure 3:
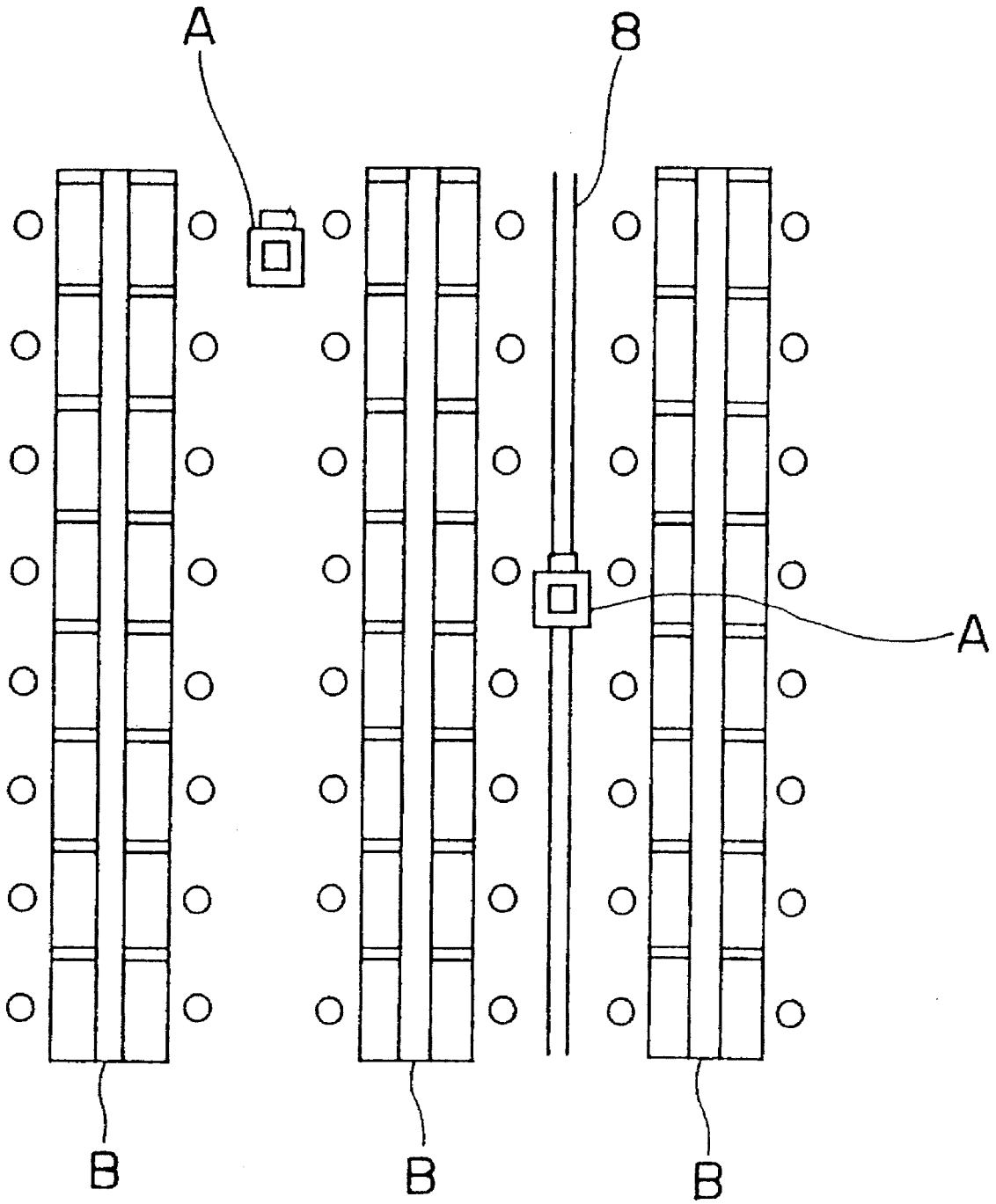
FIG. 3 is a top view showing the game parlor employing the coin counter of the first embodiment according to the present invention.

By the way, in a game parlor, as shown in FIG. 3, a plurality of slot machine islands B where a large number of slot machines are provided together, are provided at intervals. On the floor of the game parlor, a rail 8 is laid between the slot machine islands B, B. On the other hand, an engagement unit 37 which engages with the rail 8 is provided under the coin storage housing 36 of a coin counter A.

Next, how to operate the coin counter A described above will be explained below.

An employee of the game parlor, when he is called by a player, carries the coin counter A, holding a bar 11 of the coin counter A, to the player along the rail 8. The player has his coins counted for adjustment, for example when he wants to end the game, by inserting the coins into the coin counter A carried by the employee.

A concrete example of coin adjustment will now be described below.

A player inserts the coins which he has gained during the play through the coin slot 1. The number of coins inserted from the coin slot 1 is quickly counted the number and stored in the coin tank 4. Information concerning the coin count result is transmitted through the management unit 30 to the count result display unit 2, and there the count result is displayed. At this step, when the player pushes the print button 13, the management unit 30 instructs the printing unit 6 to print the count result. The printing unit 6, receiving the instruction, prints out the count result on the receipt 7 and convey it to the receipt discharging slot 12. When the player pushes the bank note dispensing button 14 at the time that the count result is displayed on the count result display, the bank note dispenser, receiving the instruction to dispense the bank notes corresponding to the number of the coins from the management unit 30, takes out the bank notes from the bank note storage unit 29, according to the instruction, and conveys them to the bank note dispensing slot 16 for dispensation.

In the case where the player inserts the bank notes from the bank note slot 17 and pushes the coin dispensing button 15, the coins corresponding to the amount of the inserted bank notes are dispensed from the coin dispensing slot 18. After bank notes inserted from the bank note slot 17 are sorted according to the bank note value, they are conveyed to the bank note counting unit 33 and there the number of inserted bank notes is counted. The information concerning the result of this count is transmitted to the management unit 30, and the management unit 30 instructs the coin dispensing unit 34 to dispense the coins corresponding to the amount of the inserted bank notes. The coin dispensing unit 34 takes out the coins from the coin tank 4, according to the instruction, and conveys them to the coin dispensing slot 18 for dispensation.

As described above, according to the present embodiment, the coin counter A can be carried close to the player in response to the player's call for adjustment and dispensation of money for the coins held by the player. In a case of the game parlor being crowded, the coin counter A can be carried away to the place out of the way of the players. Thus, the convenience of the coin counter can be improved and the flexibility of the facilities can be enhanced.

In the description above, the coin counter A is arranged to be capable of moving along the rail 8, however, in the present invention, as shown on the left side of FIG. 3, it can still function without the rail 8. Also, in the embodiment above, the display unit 2 and the printing unit 6 are provided for outputting the coin count result, a recording unit for recording the coin count result on a magnetic card or an IC card for management of the coins which the player owns may be provided instead of the display unit 2 and the printing unit 6 or with them.

In the embodiment above, although the coin counter is carried by hand, it may be carried automatically. In this case, it is better to provide on a slot machine a calling button and a transmitting unit for transmitting a slot machine identity number by radio according to the operation of the calling button, and to provide, on the coin counter, a drive mechanism for driving the wheels 5, a receiving unit for receiving the slot machine identity number and a drive-controlling unit for controlling the drive mechanism so as to move the coin counter to the slot machine which corresponds to the received identity number received by the receiving unit.

The second embodiment of the present invention will next be described according to FIG. 4 thru FIG. 8.

Figure 4:
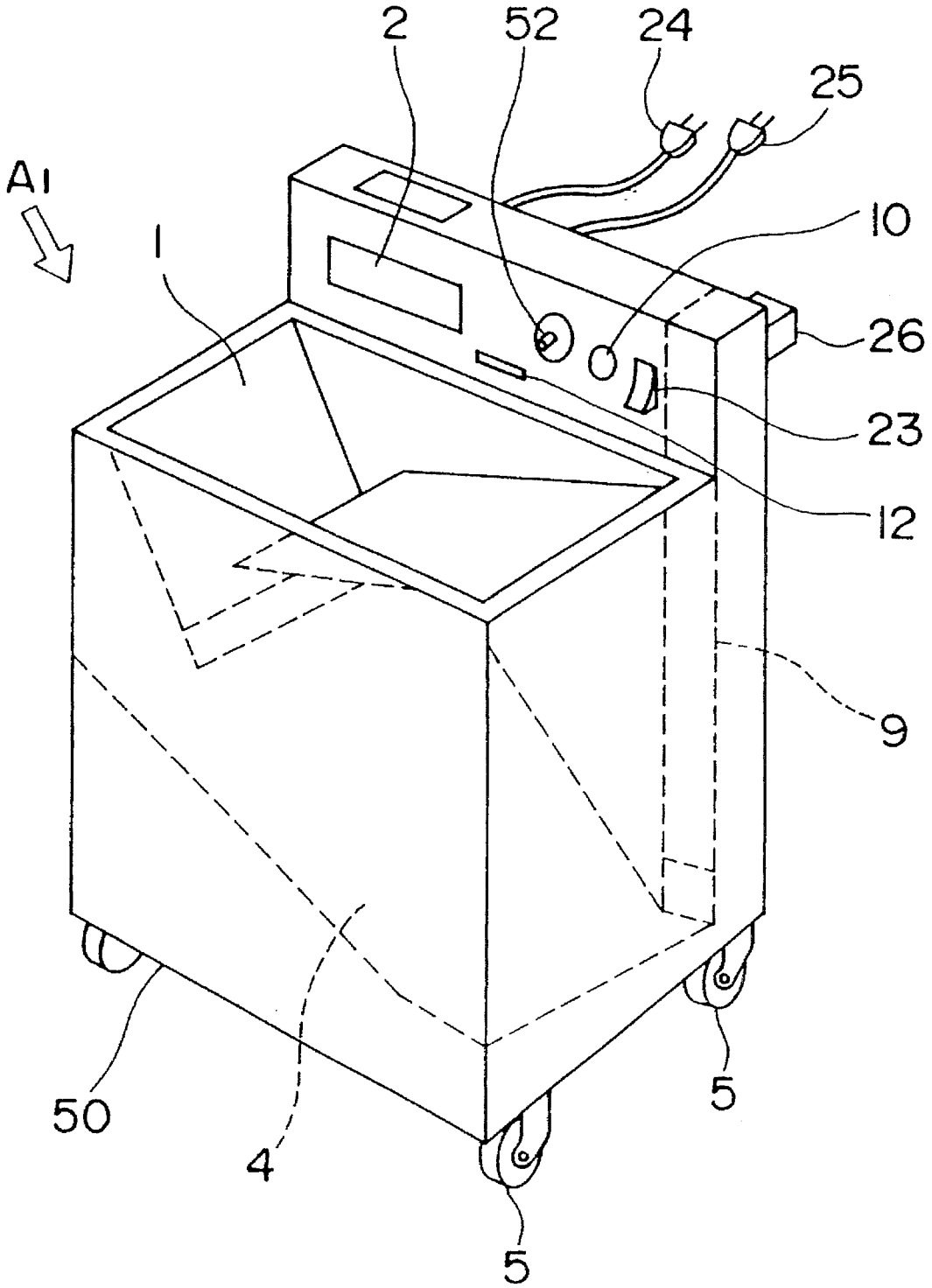
FIG. 4 is a perspective view showing the coin counter for slot machines of the second embodiment of the present invention.
Figure 5:
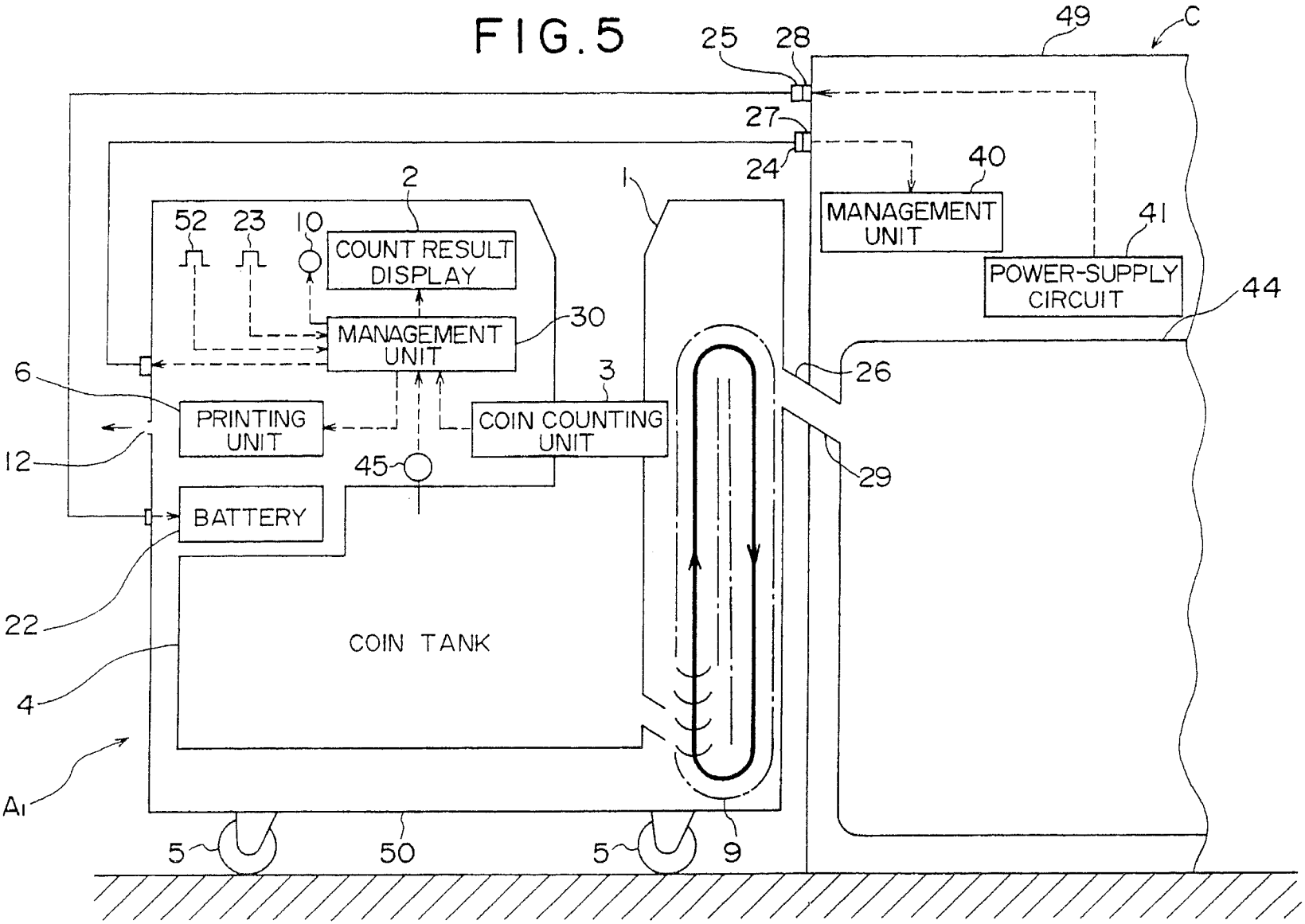
FIG. 5 is an explanatory view showing the inside structure of the coin counter for slot machines of the second embodiment of the present invention.

The coin counter $A_1$ according to this embodiment, as shown in FIGS. 4 and 5, has a housing 50 on which a coin slot 1, a receipt discharging slot 12 and a coin discharging slot 26 are formed. Under the housing 50, similar to the first embodiment, wheels or casters 5 are provided. In the housing 50, a coin counting unit 3 for counting the number of coins inserted from the coin slot 1, a count result display unit 2 for displaying the number of coins counted by the coin counting unit 3, a printing unit 6 for printing the number of coins counted by the coin counter 3 on a receipt 7, an adjustment button 52, a lifter drive switch 23, a full-up display unit 10, a management unit 30 connected to each unit by a signal line as to manage each unit, a battery 22, a coin tank 4 for storing the coins counted by the coin counting unit 3, a full-up detecting sensor for detecting whether the coin tank is filled with the coins or not and a lifter (a coin conveying means) 9 for lifting up the coins accumulated at the bottom of the coin tank 4 to the coin discharging slot 26 are provided. On the rear of the housing 50, as shown in FIG. 5, besides the above-described coin discharging slot 26, a power-supply connector 25 for charging the battery 22 and a signal connector for transmitting the information managed by the management unit 30 to the other machineries are provided.

Figure 6:
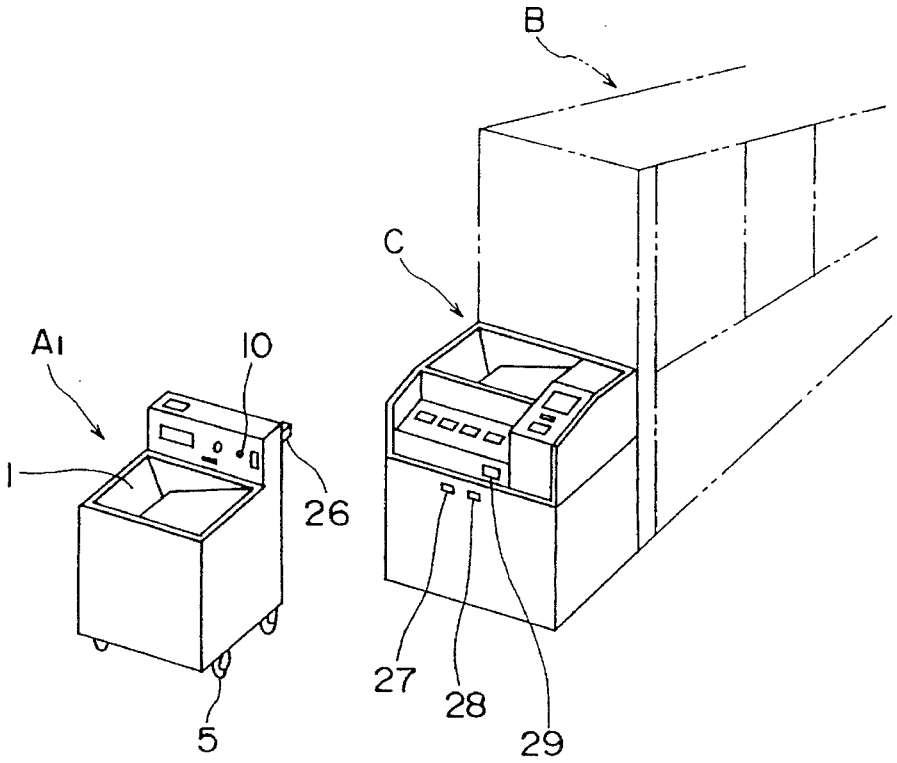
FIG. 6 is a perspective view showing the coin counters for slot machines of the second embodiment of the present invention and the slot machine island.

In the game parlor of the present embodiment, besides the above-described movable coin counter $A_1$, a fixed-type coin counter C is also provided at an end of a slot machine island B. This fixed-type coin counter C, as shown in FIG. 5, includes a management unit 40 for managing a variety of information, a coin tank 44 for storing coins, an power-supply circuit 41 and a housing 49 for storing these elements therein. On the front of the housing 49, as shown in FIG. 6, a signal connector 27, a power-supply connector 28 and a coin receiving slot 29 for receiving coins from the coin discharging slot 26 of the movable coin counter $A_1$. This fixed-type coin counter C has, not shown in the figures, the same elements as the movable coin counter A in the first embodiment, such as a coin slot, a coin counting unit, a count result display unit, a printing unit, a bank note judgement unit, a bank note storage unit, a bane note counting unit and a bank note dispensing unit. As for the movable coin counter $A_1$, similarly to the coin counter A in the first embodiment, a bank note judgement unit, a bank note storage unit, a bank note counting unit, a bank note dispensing unit and so on may be provided.

Next, how to use the movable coin counter $A_1$ of the present embodiment will be described below.

The movable coin counter $A_1$ of the present embodiment has wheels or casters 5, the same as the first embodiment, so that it can be moved in the game parlor and its convenience can be improved.

Figure 7:
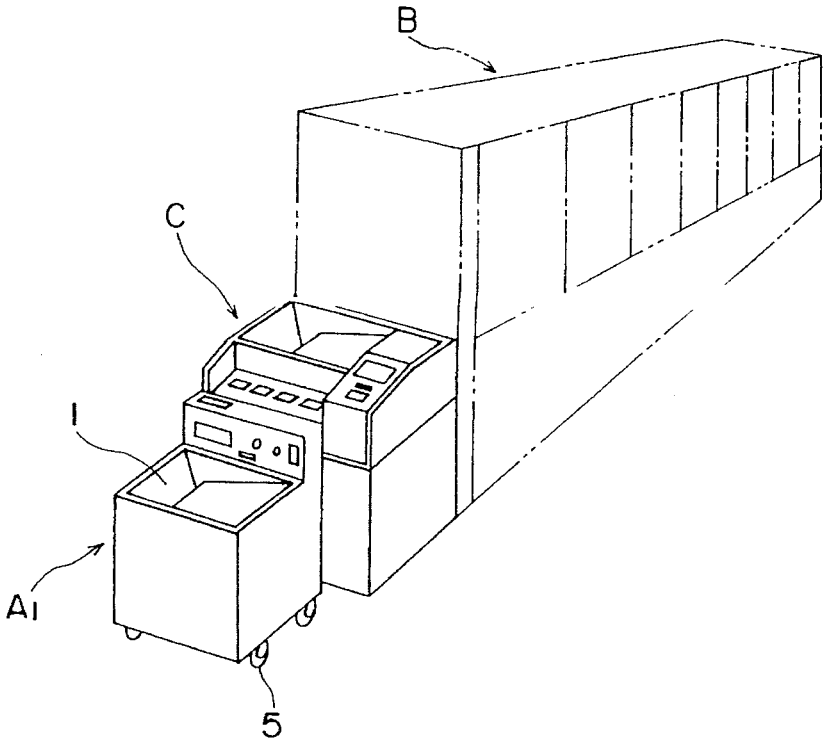
FIG. 7 is a perspective view of the coin counters for slot machines of the second embodiment of the present invention and the slot machine island showing a way of use.
Figure 8:
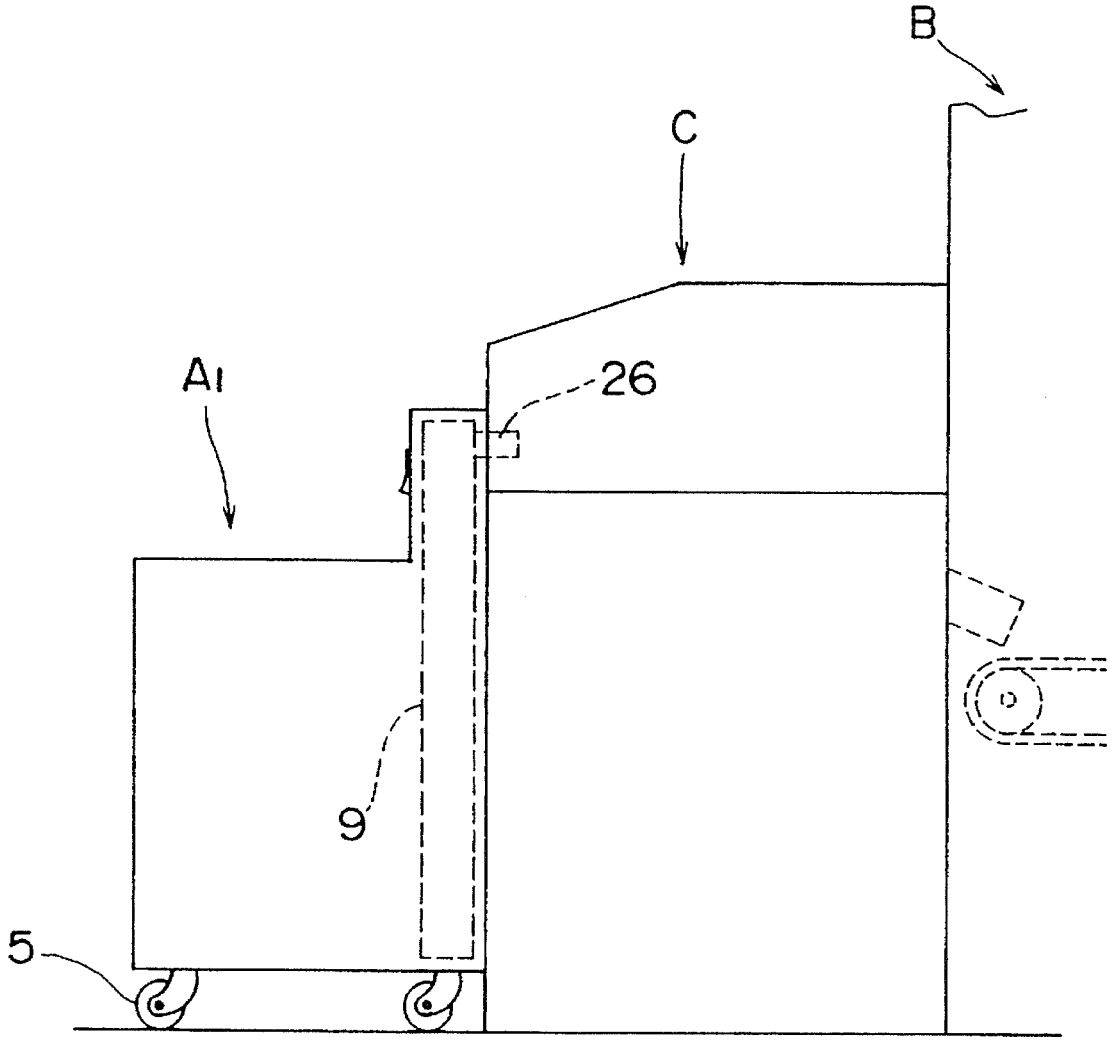
FIG. 8 is a side view of the coin counters for slot machines and the slot machine island shown in FIG. 7.

In the present embodiment, when the coin tank 4 of the movable coin counter $A_1$ is full, the coins in the coin tank 4 can be easily transferred to the coin tank 44 of the fixed-type coin counter C by connecting the movable coin counter $A_1$ to the fixed-type coin counter C which is fixed at an end of the slot machine island B. Specifically, when the coin tank 4 of the movable coin counter $A_1$ is full, the full-up detecting sensor 45 detects the situation, and outputs the information to the management unit 30. When the management unit 30 receives this, it lights up the full-up display unit 10 so as to inform an employee that the coin tank 4 is full. The employee, noticing that the full-up display 10 is lit, carries the movable coin counter $A_1$ to the fixed-type coin counter C and connects them so as to connect the coin discharging slot 26 of the movable coin counter $A_1$ to the coin receiving slot 29 of the fixed-type coin counter C, as shown in FIGS. 5, 7 and 8. Then, pushing the lifter drive switch 23, the lifter 9 of the movable coin counter $A_1$ drives so that the coins in the coin tank 4 are lifted up to the coin discharging slot 26 and are transferred to the coin tank 44 of the fixed-type coin counter C through the coin receiving slot 29 of the fixed-type coin counter C. The coins in the coin tank 44 of the fixed-type coin counter C are conveyed to each slot machine in the slot machine island B by a conveyer.

In the case that the coin discharging slot 26 of the movable coin counter $A_1$ is connected to the coin receiving slot 29 of the fixed-type coin counter C, by connecting the power-supply connector 25 of the movable coin counter $A_1$ to the power-supply connector 28 of the fixed-type coin counter C, the battery 22 of the movable coin counter $A_1$ is charged through the power-supply circuit 41 of the fixed-type coin counter C. Furthermore, by connecting the signal connector 24 of the movable coin counter $A_1$ to the signal connector 27 of the fixed-type coin counter C, the information managed by the management unit 30 of the movable coin counter $A_1$, for example, the information concerning the number of coins inserted into the movable coin counter $A_1$, is transmitted to the management unit 41 of the fixed-type coin counter C.

According to the present invention, the coin counter is moved freely so that a player can count the coins for adjustment where he is by carrying the coin counter to the place. Thus, the coin counter of the present invention enables improvement of the convenience for the players. In addition, when the game parlor gets crowded, the coin counter can be moved out of the way so as to maintain a good environment in the game parlor.

We claim:

1. A game parlor comprising:

a plurality of slot machines mounted on a floor of the game parlor, said slot machines being operated by players by inserting coins therein;

rails provided adjacent the slot machines on said floor;

a coin counter for slot machines comprising, a main body having a coin slot in which said coins are inserted, a coin counting means for counting the number of coins inserted in the coin slot, a coin tank for storing coins counted by the coin counting means, and a count result outputting means for outputting the result of the coin counting made by the coin counting means, wheels provided under the main body for moving said main body, and an engaging unit which engages said rails so as to move the coin counter along said rails.

2. A game parlor as defined in claim 1 wherein said count result outputting means is a count result recording means for writing the count result produced by said coin counter on a receipt or a card.

3. A game parlor as defined in claim 1, wherein said count result outputting means is a count result displaying means for displaying the count result produced by said coin counting means.

4. A game parlor as defined in claim 1, wherein said coin counter comprises:

a bank note storing unit for storing bank notes; and a bank note dispensing means for dispensing bank notes of an amount corresponding to the number of coins counted by said coin counting means, from the bank note storage unit.

5. A game parlor as defined in claim 1, wherein said coin counter comprises:

a bank note slot where bank notes are inserted;

a bank note counter for counting the amount of bank notes inserted through the bank note slot; and a coin dispenser for dispensing coins in the amount corresponding to the count result produced by the bank note counter, from said coin tank.

6. A game parlor as defined in claim 1, wherein said coin counter comprises:

a bank note slot where bank notes are inserted;

a bank note counter for counting the amount of bank notes inserted through the bank note slot;

a bank note storing unit for storing bank notes;

a coin dispenser for dispensing coins, in the amount corresponding to the count result produced by the bank note counter, from said coin tank; and a bank note dispensing means for dispensing bank notes of an amount corresponding to the number of the coins counted by said coin counting means, from the bank note storing unit.

7. A game parlor as defined in claim 1, wherein said coin counter comprises:

a full-up detecting means for detecting whether said coin tank is filled up with coins or not, and a full-up alarm outputting means for outputting an alarm indicating that the full-up detecting means detects that the coin tank is full.

8. A game parlor comprising:

a plurality of slot machines, operated by players by inserting coins therein, each of Said slot machines having a calling button and a transmitting means for transmitting by radio the identity number of the slot machine whose calling button is operated; and a coin counter for slot; machines comprising, a main body having a coin slot in which said coins are inserted, a coin counting means for counting the number of coins inserted in the coin slot, a coin tank for storing coins counted by the coin counting means, and a count result outputting means for outputting the result of the coin counting made by the coin counting means;

wheels provided under the main body for moving said main body, drive means for driving said wheels, a receiving means for receiving said identity number transmitted from said transmitting means, and drive control means for controlling said drive means so as to move the coin counter in proximity to the slot machine corresponding to the identity number received by said receiving means.

9. A game parlor as defined in claim 8 wherein said count result outputting means is a count result recording means for writing the count result produced by said coin counter on a receipt or a card.

10. A game parlor as defined in claim 8, wherein said count result outputting means is a count result displaying means for displaying the count result produced by said coin counting means.

11. A game parlor as defined in claim 8, wherein said coin counter comprises:

a bank note storing unit for storing bank notes; and a bank note dispensing means for dispensing bank notes of an amount corresponding to the number of coins counted by said coin counting means, from the bank note storing unit.

12. A game parlor as defined in claim 8, wherein said coin counter comprises:

a bank note slot where bank notes are inserted;

a bank note counter for counting the amount of bank notes inserted through the bank note slot; and a coin dispenser for dispensing coins in the amount corresponding to the count result produced by the bank note counter, from said coin tank.

13. A game parlor as defined in claim 8, wherein said coin counter comprises:

a bank note slot where bank notes are inserted;

a bank note counter for counting the amount of bank notes inserted through the bank note slot;

a bank note storing unit for storing bank notes;

a coin dispenser for dispensing coins, in the amount corresponding to the count result produced by the bank note counter, from said coin tank; and a bank note dispensing means for dispensing bank notes of an amount corresponding to the number of the coins counted by said coin counting means, from the bank note storing unit.

14. A game parlor as defined in claim 8, wherein said coin counter comprises:

a full-up detecting means for detecting whether said coin tank is filled up with coins or not, and a full-up alarm outputting means for outputting an alarm indicating that the full-up detecting means detects that the coin tank is full.

* * * * *